US005413829A

United States Patent [19]

Brown et al.

[11] Patent Number: 5,413,829

[45] Date of Patent: May 9, 1995

[54] SELF-ADHESIVE WALLCOVERINGS

[75] Inventors: Kenneth D. Brown, Tyne & Wear; David A. Williams, Alnwick, both of England

[73] Assignee: Forbo-CP Limited, England

[21] Appl. No.: 50,091

[22] PCT Filed: Sep. 14, 1992

[86] PCT No.: PCT/GB92/01685

§ 371 Date: Jul. 21, 1993

§ 102(e) Date: Jul. 21, 1993

[87] PCT Pub. No.: WO93/06301

PCT Pub. Date: Apr. 1, 1993

[30] Foreign Application Priority Data

Sep. 13, 1991 [GB] United Kingdom ..... 9119655

[51] Int. Cl.[6] ..... D21H 27/20

[52] U.S. Cl. ..... 428/40; 156/71; 156/249; 156/344; 206/389; 206/400; 428/219; 428/220; 428/321.1; 428/346; 428/352; 428/354; 428/355; 428/511; 428/514; 428/904.4; 428/906

[58] Field of Search ..... 428/40, 904.4, 906, 428/343, 219, 220, 352, 354, 355, 274, 511, 346, 514, 321.1; 156/71, 249, 344; 206/389, 397, 400, 410, 411

[56] References Cited

U.S. PATENT DOCUMENTS 3,620,366 11/1971 Parkinson ..... 428/904.4

FOREIGN PATENT DOCUMENTS

3741194A1 8/1989 Germany .
1241177 7/1971 United Kingdom .
1264795 2/1972 United Kingdom .
1315114 4/1973 United Kingdom .
1493407 11/1977 United Kingdom .
1511110 5/1978 United Kingdom .
2110956 6/1983 United Kingdom .
2117271 10/1983 United Kingdom .
2171956 9/1986 United Kingdom .

OTHER PUBLICATIONS

William E. Scott and Stanley Trosset, "The Influence of the Environment on Paper Properties", pp. 89–99, Copyright 1989, Tappi Press.

*Primary Examiner*—Nasser Ahmad
*Attorney, Agent, or Firm*—Dickstein, Shapiro & Morin

[57] ABSTRACT

A package comprising a sealed container containing a roll of wall covering material which comprises a hydrophilic substrate layer, a pressure sensitive adhesive layer on one surface and, on the other surface, a decorative layer, usually including a layer of PVC or other plastics material. The wallcovering material is preferably self-wound on a roll. The moisture content of the wallcovering material is controlled in the package so as to provide a desired area of the product which falls between the area of the product where it is soaked in water under predetermined conditions and the area of the product when it is preconditioned under relatively dry, predetermined conditions. The moisture content is generally above the equilibrium content under normal ambient conditions so that any problems caused by expansion of the product in use under humid conditions, such as bubbling and raising of the edges of the material at seams, are minimised. In a process for producing the product the moisture content is monitored during the process, usually downstream from a drying stage, for instance the drying stage following application of an aqueous adhesive.

28 Claims, No Drawings

SELF-ADHESIVE WALLCOVERINGS

BACKGROUND OF THE INVENTION

This invention relates to wallcovering product that comprises a decorative sheet material which carries a layer of pressure sensitive adhesive and which is supplied in the form of a roll.

Conventional wallcoverings either require wet adhesive to be applied to the back of the sheet material for application to a wall or, in the case of ready pasted products, require application of water. These products are inconvenient to use, since the handling of the paste and brushes or water troughs requires that furniture and preferably also carpets be removed from the vicinity of the walls to which the wallcoverings are being applied.

In addition, wet wallcoverings become soft and present handling difficulties. Stretching of the product can occur and can lead to difficulties in matching the pattern repeat on the walls. Walls with lining paper must be sized with glue or the lining paper must be removed before application of further wallcovering and these tasks are inconvenient and time consuming. Once these types of products are applied to the wall and the adhesive has dried it is, however, rare for the dimensional stability, or rather inherent lack thereof, of paper-based substrates to cause problems on changing humidity.

In order to overcome the above-mentioned problems, it has been proposed to provide wallcovering material with a pressure sensitive adhesive or a heat activatable adhesive already in place so that a roll can be unrolled and immediately applied to a wall surface without wetting being necessary. However, generally wallcoverings comprise cellulosic substrates primarily for reasons of economy and there are difficulties with the dimensional stability of these types of products when in place on a wall due to changing moisture content of the atmosphere, especially when exposed to humid environments such as bathrooms. Dimensional stability is a particular problem when the sheet material comprises an adhesive layer, a substrate layer and a decorative-surface layer, the surface layer being provided on a layer of polymeric material such as for example, PVC, ie, a vinyl wallcovering. This type of wallcovering is described for example, in GB 1264795 and GB 1315114.

The particular difficulty arises with polymeric coated substrates, when the atmosphere becomes humid, because water vapour is transmitted through the polymeric coating into the substrate layer. Although this might not be a problem, if the substrate is wholly non-hydrophilic, for economic reasons it always contains hydrophilic material. As a result the transmitted moisture from the atmosphere will be absorbed by the substrate layer and this will cause expansion which may be considerable. This can then give rise to bubbling of the product on the wall or the edges of adjoining strips can become raised. Also, when the external air temperature rises and relative humidity falls, moisture escapes from the product and can cause the product to shrink due to the fibre shrinkage and so leave gaps between strips, though this is less of a problem than that of expansion.

Various methods have been suggested to overcome the problems of dimensional stability of this type of wallcovering product. One way to overcome the problem of dimensional stability could be to use a substrate which does not include hydrophilic material so that differing humidities will not affect the material. Suitable non-hydrophilic substrates include for example glass fibre and polyester fibres. However, such substrates are very expensive and therefore not preferred.

In DE-A-3741194, in order to avoid formation of creases in the wallcovering, it is suggested to use a substrate which expands relatively little in damp conditions, in addition to using an adhesive in the form of small islands of foam so that expansion and contraction which give dimension changes in the substrate caused by moisture changes in the room, will be diverted in a direction away from the wall surface due to micro expansion between adhesive points. In GB 2117271, "dry-on dry-off" wallcoverings, i.e. those which do not require a wetting stage for their application and which use a pressure-sensitive or heat activated adhesive are described. The problem of dimensional stability of paper-based substrates with increasing as well as lowering humidity is said to be overcome in that disclosure by using dimensionally stable substrate material such as a closed cell foamed film of LDPE, ethylene copolymer non-woven or spun-bonded products, including a glass fibre stabilised cellulosic web. Whilst these products may give greater dimensional stability than conventional cellulose substrates, they tend to be extremely expensive and still do not give total dimensional stability. The cellulose containing substrate will still absorb water in humid atmospheres and expansion and contraction of the product will therefore result.

GB 1241177 also recognises that changing moisture content can affect the dimensional stability of paper-based substrates and that pre-pasted coatings which are activated by moistening cause particular dimensional instability problems. The solution is to use adhesives activatable by heat and/or pressure rather than by application of water. Wetting the paper prior to application is suggested to ensure against buckling when the paper is to be hung at high humidities. However, this counteracts the benefit of having a pressure-sensitive adhesive already in place, if a wetting step is still necessary for application. In addition, such a wetting step produces the problems discussed above in that wet wallcoverings become soft and present handling difficulties and stretching may occur.

In addition to the dimensional problems of self adhesive coated wallcoverings, caused by varying humidity, generally, the adhesive is applied in an aqueous or other solvent-based composition and excess water is subsequently removed in a drying step. Typically when the adhesive is aqueous based, it will contain from 40 to 70% water or organic solvent at the point of application to the web and the drying temperatures vary considerably but are generally in the range of 50° to 150°0 C. or more. As a result the substrate shrinks and is usually dried to below the moisture content it would have after prolonged exposure for a normal atmosphere. If it is applied to the wall in this shrunk state, normal atmospheric humidity is liable to cause expansion.

In practice the wallcovering is packed in a roll that is either freely exposed to the atmosphere or is enclosed in a plastic wrapping that is usually open at the ends. Some equilibration with atmospheric humidity will normally occur, but the effect may be non uniform with the result that the wallcovering will have varying moisture content, and stretch potential, along its length.

We have now found that problems resulting from the lack of dimensional stability in use in the normal range of environments can be overcome if the wallcovering is supplied ready for application to the wall at particular dimensions such that the expansion possible under usual conditions of use, beyond the original dimensions, is so small as not to cause bubbling or raising of edges, this being achieved preferably by ensuring that the moisture content of the material in the roll is greater than the equilibrium moisture content under normal conditions.

SUMMARY OF THE INVENTION

A new package according the present invention comprises a sealed container containing a roll of wallcovering material for application in adjacently positioned strips to a wall comprising in sequence a pressure sensitive adhesive layer, a hydrophilic substrate layer, a decorative surface layer and a release surface, the adhesive layer of one winding being received on the release surface of the adjacent winding, in which the material is such that it will undergo an increase in area from a dry area d to a wet area w of at least 0.01% of d when subjected to a wet expansion test (as hereinafter defined), and is characterised in that the material in the package has an area which is such that $$\mu - y\Delta \leqq x \leqq \mu + z\Delta$$

where $\mu$ is $$\frac{d+w}{2}$$

$\Delta$ is $$\frac{w-d}{2}$$

y is in the range −0.5 to 0.8 z is in the range −0.8 to 0.95

The present invention is of most value where the increase in area in the wet expansion test is at least 0.2% of the dry area (d), preferably at least 0.5% and may be more than 1%. In general the increase in area is less than 5%, and is more usually less than 2%.

DESCRIPTION OF THE PREFERRED EMBODIMENT

The hydrophilic substrate layer comprises some hydrophilic material, generally fibrous. Generally the hydrophilic material is cellulose based, for example cellulose, cellulose acetate or viscose, preferably being cellulose. The amount of hydrophilic material in the hydrophilic substrate layer will generally be at least 10%, preferably at least 20% and most preferably at least 40%. Generally, the hydrophilic material in the hydrophilic substrate layer will be no greater than 80%, preferably no greater than 70% and most preferably no greater than 60% by weight of the substrate.

The hydrophilic substrate layer will generally also include some synthetic and/or mineral material, generally fibres, which are largely unaffected by water (which may be in the form of water vapour) in that they absorb substantially no water. Such "hydrophobic" materials may be included in the composition of the hydrophilic substrate layer generally in amounts of at least 3% by weight, preferably at least 10% and most preferably at least 15% by weight. Generally the hydrophobic material will be included in an amount no greater than 60% by weight, preferably no greater than 50% by weight and most preferably no greater than 30% by weight of the layer.

The hydrophobic material may be any material which is substantially unaffected by water, preferred materials are for example, glass or other mineral fibres or synthetic fibres such as polyester polymers and copolymers of $\alpha$-olefin, such as ethylene and propylene. Synthetic fibres are preferred as they are less hazardous. Although the use of various different "hydrophobic" materials will give different properties to the substrate layer such as strength, acidity and opacity, these properties are relatively unimportant compared with dimensional stability and tend to be superior to the properties of a 100% cellulose substrate that is the value of $\Delta$ as a proportion of d is lower.

The total content of hydrophilic/hydrophobic material which is preferably fibrous material, in the hydrophilic substrate layer may be up to 100% but is generally no greater than 98%, preferably no greater than 95% and most preferably no greater than 90% by weight. When the substrate comprises less than 100% by weight hydrophilic/hydrophobic material, the remainder comprises a filler and/or pigment and/or binder. Suitable fillers and pigments are those which are conventionally used in cellulosic substrates for example clays and chalks.

Generally the binder will be a synthetic binder such as a polyvinyl acetate and/or polyvinyl acrylate binder or SBR latex. A suitable binder is generally included in amounts of at least 5%, preferably at least 15%, most preferably at least 20% by weight of the hydrophilic substrate layer, generally being no greater than 40% and preferably being no greater than 35% by weight.

The dimensional stability of the hydrophilic substrate layer is measured by the wet expansion of the layer. Wet expansion tests are carried out by soaking preconditional a 500×500 mm sample for a period of at least 2 hours at a temperature maintained at 23°±2° C. and at 50%±5% relative humidity. The sample being laid out flat with its adhesive coating in contact with a substrate surface comprising. The sample (carried on the substrate is then immersed in water at 21° C. for one minute, draining of the excess water and measuring the change in dimensions after 15 minutes on a flat surface in the same 23°±2° C. and 50%±5% relative humidity environment. The expansion in area is then expressed as a percentage of the original area of the sample.

The area x of the material in the package is generally controlled by controlling the moisture content of the material before it is packaged. The moisture content of the material in the package is preferably higher than the content at equilibrium at 23° C. and 50% RH. Generally the moisture content of the product is higher than the equilibrium moisture content under the usual ambient conditions which would be subsisting during package, storage and application of the wallcovering, in order to obtain x within the desired range. For instance the moisture content, based on the total amount of hydrophilic fibres in the hydrophilic layer is generally at least 15% by weight, more preferably at least 17% by weight, preferably at least 18% by weight.

The value of y, which determines the lower end of the range for the area x, is preferably in the range −0.5 to 0.5, more preferably in the range −0.25 to 0.25. It is thus in the vicinity of the mid point between the wet and dry areas of the material. The value Z is in range −0.8 to 0.95, preferably in the range −0.5 to 0.90, more preferably in the range 0 to 0.8, most preferably in the range 0.25 to 0.75. The upper end of the range within which the area x should fall is therefore somewhat above the mid point between wet and dry areas. It is preferred therefore for the area x to be just above the mid point between the dry and wet areas. With these parameters, it has been found that any increase in area under relatively humid conditions beyond the original area of the product on application to the wall initially (which will not be greatly different from the value x, causes relatively few bubbling problems and problems related to edges of abutting strips becoming raised. Likewise from such an original area, the reduction in area under normal ambient conditions does not cause problems.

The moisture content of products of this type comprising hydrophilic materials depends generally upon the content of hydrophilic material in the product. Under normal conditions of temperature and humidity (and that is around 23° C. and 50% relative humidity) the moisture content of a hydrophilic fibre-containing product will generally be around 15% based on the weight of hydrophilic fibre. Accordingly in the present invention the moisture content of the wallcovering material in the package is preferably at least 15% by weight, more preferably at least 18% by weight. Generally the moisture content is less than 40% by weight based on hydrophilic fibre, more preferably less than 25% by weight.

The invention is particularly directed to a product in which the decorative layer comprises a polymeric material, generally a PVC layer, thereby producing a product with all the beneficial properties of a conventional vinyl wallcovering i.e. which is washable, has good durability and enables easy embossing, in addition to easy dry-on application to wall surfaces and good dimensional stability. Examples of synthetic resin materials which may be used in the coating include polyvinyl chloride, polyethylene, polypropylene, polyolefins and other similar polymers. Foamed synthetic polymers may be for example, expanded polystyrene.

The decoration on the surface of the decorative layer have been provided by any of the conventionally known means for example by printing, embossing and/or coating. It may be provided by, or printed etc on, a vinyl, foamed or unfoamed coating on which comprises the decorative layer on the surface of the hydrophilic substrate layer. Alternatively the decorative layer may be provided directly onto the surface on one side of the hydrophilic substrate layer by the conventional means, by printing, embossing and/or coating.

The pressure sensitive adhesive layer comprises an adhesive which is a permanently tacky pressure sensitive adhesive which will enable the wallcovering material to be stuck on to a wall surface and yet which will also enable its removal for re-decoration after the useful life of the wallcovering material.

For best results the adhesive should have good cohesive strength (as shown by resistance to shear) and preferably it also has particular tack and peel adhesive properties. These properties can all be determined by FINAT tests (tests of the Federation International de Thermocollants sur Papiers et autre Supports). The measurements recorded below are determined by modified FINAT tests, as described:

Cohesive strength (resistance to shear) measurements are taken using a test piece with dimensions 110 mm×20 mm. The test pieces comprise a substrate of 36 μm "MELINEX" (manufactured by Imperial Chemical Industries, PLC.) polyester film having a coating of the pressure sensitive adhesive under test at a coating rate to give a dry weight of 35 g/m$^2$. A test piece is partially bonded to a standard (glass plate) surface, the bond area under test has dimensions 20 mm×20 mm by rolling the test area with a roller. A 1.5 kg weight is applied to one end of the sample hanging from the bottom of the vertical glass plate and the time taken for the bond to break under shear is recorded. The tests are carried out at 23°±2° C. and 50%±5% RH.

Generally the cohesive strength of the adhesive will be at least 45 minutes, preferably at least 55 minutes and most preferably greater than 1 hour when tested for shear resistance in accordance with this test.

The peel (adhesion) strength is measured using 180° peel tests on a test piece having dimensions 100 mm×25 mm. The substrate and adhesive coat are as described above for the cohesion tests. A sample is applied to a stainless steel surface and rolled in one direction only, five times with a 2 kg rubber roller. Tests are carried out on samples with a dwell time on the plate (before peeling) of 3 minutes and 60 minutes and the peel speed is 300 mm/min. Peel strength is recorded in N/25 mm. Again, these tests are carried out at 23°±2° C. and at a relative humidity of 50±5%.

The adhesion (peel) strength is preferably in the range 2 to 15N/25 mm, most preferably being above 5 and generally being no greater than 12N/25 mm. After 1 hour dwell time the adhesion is preferably at least 10N/25 mm, most preferably it should be at least 12N/25 mm.

Preferably, the adhesive must allow easy application to the wall and also easy removal and adjustment of the position of the wallcovering prior to its final positioning. In addition, the adhesion must strengthen with time, approaching a maximum for example, after up to about 10 hours. It has been found that using the particularly preferred adhesives, as the adhesion strengthens with time, so does the cohesion develop, to approach a maximum. The time between application and development of the maximum adhesion, the so-called open-time, inevitably tends to be relatively high with pressure sensitive adhesives and it is this property which can allow the wallcovering to bubble by an increase in area under changing conditions of humidity during the period after application to a wall when the adhesion and cohesion are low.

The use of an adhesive having high adhesion alone is not sufficient to give significantly improved properties but using adhesives having the combination of adhesion and cohesion described above does give a beneficial result in resisting the tendency of the wallcovering to move due to changing atmospheric conditions i.e. expansion at high humidity and contraction at low humidity. The high cohesive strength of the bond enables the adhesive to tend towards a solid bond between the wallcovering and the wall, enhancing dimensional stability.

Tack is measured using a loop tack test with test pieces of 200 mm×20 mm. The test conditions are as for the cohesion and peel tests. The band area under test is 25 mm×25 mm on a glass plate and the speed is 300 mm/min.

Preferably the adhesive properties will also provide products in which when two adhesive coated surfaces of the product touch one another they may be separated substantially without damage to the product.

Suitable adhesives may be produced from synthetic and/or natural products, the natural rubbers being compounded with tackifying resin. The most highly preferred type of adhesive will be an acrylic based adhesive such as a polyacrylate-based aqueous emulsion adhesive.

Generally, the adhesive will be present in the product at a dry weight of from 5 to 60 grammes per $m^2$, preferably above 10 $g/m^2$ and below 50 $m^2$ and most preferably at a weight of 20 to 40 grams per $m^2$, dry weight. However, the adhesion is affected by the thickness and stiffness of the substrate and the particular adhesive used and the amount of adhesive required is dependent upon these factors. In addition, the adhesion is also affected by the contact area of the wallcovering with the wall surface when in place on the wall. The contact area is affected, for example, by embossing and a large depth of embossing may reduce the contact area considerably. Generally the contact area should be above 50% of the wallcoverings area, preferably at least 60% and most preferably at least 70%. When the contact area is low, generally, a higher coating weight of adhesive is required.

The release layer may be any material which will enable the wallcovering roll to be unwound without transfer of adhesive to the decorative-surface layer or damage to any part of the product. Any conventional release layer may be used such as a coating of a release substrate or a separate physical layer known as release liner which will be removed prior to application to a wall. The use of a release liner is not preferred because additional cost is incurred in manufacturing the product, handling and application become more difficult and after application of the wallcovering, the liner must be disposed of. A preferred release coat is a coating of silicone based polymer preferably a cross-linked silicone polymer, on the decorative-surface layer.

Release properties may also be effected by use of a suitable texture/emboss finish on the decorative surface layer without the need to use, for instance, a silicone based polymer coating.

The packaging material may be any material which provides a barrier against moisture permeation in to, or out of, the roll and is generally a synthetic polymeric material. Suitable polymeric films include those based upon polyolefins for example, polyethylene, polypropylene and polyethylene-polypropylene copolymer materials or PVC.

Generally, the rolls will be shrink-wrapped. Conventional shrink wrapping may entirely cover the rolls or will, unless special precautions are taken, leave the ends open requiring sealing by provision of a sealing disc of the packaging material or other suitable material should be applied on the ends of the packaged roll to seal the roll package. Most preferably, such discs will be self-adhesive.

The present invention provides also a new process for producing a package containing a roll of wallcovering material in which there are applied to a web of hydrophilic substrate material, on one side a decorated surface layer and on the other side a layer of pressure sensitive adhesive and the product web is wound into rolls of successive winding with the pressure sensitive adhesive received onto a release surface of the adjacent winding in the product roll, and the roll is then enclosed in a sealed container, in which the wall covering material is such that it will undergo an increase in area from a dry area d to wet area w of at least 0.01% of d when subjected to the wet expansion test as hereinbefore defined) characterised in that the area x of the wall covering material when the roll is enclosed in the sealed container is in the range $$\mu - y\Delta \leqq x \leqq \mu + Z\Delta$$

where $\mu$ is $$\frac{d+w}{2}$$

$\Delta$ is $$\frac{w-d}{2}$$

y is in the range −0.5 to 0.8

Z is in the range −0.8 to 0.95

In another embodiment of the invention a product, which may or may not have area x within the range defined for the new product of the invention, is made by a process comprising the same process steps as the first process embodiment and is characterised by being carried out in the presence of moisture and in the process the moisture content of the web before it is wound and packaged is determined. The result of the determination of the moisture content can be used to adjust the process conditions so as to alter the moisture content of the web in the product. For instance the process may include a drying step upstream from the winding step and the conditions in the drying step are adjusted as a result of the moisture content determination which is conducted downstream from the drying stage. The moisture content of the web of the product is higher than the equilibrium content at 23° C., 50% RH.

In the process the adhesive coating is generally applied in the form of a water-based or non-aqueous solvent-based solution or an emulsion, or as a hot melt or in a radiation (UV or electron beam) curable form. Preferably the adhesive is water based as avoidance of non-aqueous salts is environmentally desirable and avoids the provision of complicated solvent recovery apparatus and procedures. The use of water based systems also supplies the moisture and allows control of the moisture content of the final product without the incorporation into the process of an extra stage of humidification and/or drying. The preferred adhesives are acrylic ester polymers, generally prepared and applied as an aqueous emulsion. The selection of an appropriate adhesive to obtain the desired properties in the final product as disclosed above is a matter of choice by a person skilled in the art selecting amongst available polymers, application rates and additives.

The moisture content of the wallcovering is measured by a suitable technique. An analysis of the final package product may be carried out by subjecting a sample to a Karl Fisher determination, for instance. A particularly convenient method uses an infra-red sensor, for instance the "QuadraBeam" by Moisture Systems. This allows determination of the moisture content of the final product or of a web as it is manufactured, for instance as it is moving through a converting line. The signals from the sensor can be calibrated to known absolute moisture contents by determination of those figures using an alternative analytical technique. The expression of the result as a percentage of the total hydrophilic fibre content, or of the content of other components, can be obtained by using the known, or analytically determined, weights of those other components.

The following examples illustrate the invention.

EXAMPLE 1

A substrate layer of "VARITESS V277.100" (manufactured by Papierfabrik Lahnstein GmbH.) having a dry weight of 100 g/m$^2$ and comprising 50% cellulose fibres, 20% polyester fibres, the remainder comprising mainly polyvinylacetate binder and having a wet expansion of 0.3%, was coated with 110 g/m$^2$ PVC plastisol comprising PVC resin: 100 parts by wt; DOP plasticiser: 67 pbw; Filler 50 pbw; Titanium dioxide 35 pbw; and Stabiliser 2 pbw. The wet expansion of the coated substrate is 0.2%.

The vinyl coated substrate was printed and a silicone release coat comprising 0.5 g/m$^2$ dry Rhodorsil 7334 cross-linked with catalysts 62A and 62B, from Rhone-Poulenc Silicones was applied during the printing process on top of the print. The printed, coated substrate was dried travelling at a rate of 50 meters per minute at a temperature of 100° C.

The printed, coated web was then embossed at 100 meters per minute on a conventional hot embosser and an adhesive coating was applied at 80 meters per minute with 60 grams per m$^2$ of an acrylic adhesive comprising VANTAC 301 acrylic emulsion from Rhone Poulenc Chemicals having a solids content of 50% the dry weight coating thus being 30 g/m$^2$. The adhesive coated web, after drying was wound up into large reels with a moisture content of 7% based on the total weight of substrate layer and adhesive layer, determined by an IR sensor positioned on the web after the drying step, but before the winding step. The equilibrium moisture content at 23° C., 50%. RH is 6%.

Smaller retail rolls were reeled off during inspection immediately and up to 1 month later with good release and no damage to the product and these 10 m×0.5 rolls labelled and shrink wrapped with polyolefin film and/or PVC film in the normal manner.

On testing after various periods of aging it was found that reels could be unwound easily, that lengths of wallcovering could be easily applied, removed and re-applied several times without difficulty or damage to gloss, eggshell, matt emulsion, vinyl silk emulsion painted surfaces and to lining paper.

In addition, the product could easily be separated from itself after two adhesive coated surfaces were stuck together, without damage.

The product was subjected to the following environmental testing on all the above mentioned wall surfaces.

½ hour steam at 20° C. (i.e. 100% RH)
½ hour ambient 20° C.
7 hours at 20° C. and 65–75% RH
4 hours at 25°–30° C., and 30–40% RH
12 hours ambient 15°–20° C. and 30–40% RH The product was tested for 14 days under these conditions and showed no signs of bubbling or expansion at the seams and only insignificant shrinkage at the seams during the 16 hours at 30–40% RH at temperatures between 15° and 30° C. The steam condition represents the very high humidities to be found in bathrooms and kitchens.

The self adhesive product was applied to the wall surfaces using light hand pressure only ensuring all air was excluded between the wallcovering and the wall by easily sweeping such air bubbles as in the case of conventional wallcoverings.

The product also had the advantages of being easier to cut and trim than wet wallcovering, and was not stretched during application to walls and was therefore easier to match and produced no mess.

EXAMPLE 2

A wallcovering substantially as described in Example 1 was produced, but omitting the PVC plastisol layer and having a hydrophilic substrate layer of 160 g/m$^2$ in weight. The decorative surface layer was printed immediately onto the hydrophilic substrate layer, and the release coat applied.

The resultant product performed similarly to that in Example 1 when subjected to the same testing.

We claim:

1. A package comprising a sealed container in combination with a roll of wallcovering material for application to a wall in strips, said sealed container containing said roll of wallcovering material and said wallcovering material comprising in sequence a pressure sensitive adhesive layer, a hydrophilic substrate layer, a decorative layer and release surface, the adhesive layer of one winding being received on the release surface of the adjacent winding, in which said wallcovering material is such that it will undergo an increase in area from a dry area d to a wet area w of at least 0.1% of d when subjected to a wet expansion test, and wherein said wallcovering material in the package has an area which is such that $$\mu - y\Delta \leqq x \leqq \mu + z\Delta$$

where $\mu$ is $(d+w)/2$
$\Delta$ is $(w-d)/2$
y is in the range −0.5 to 0.8 and
z is in the range −0.8 to 0.95, and moisture content in the package is controlled to be above ambient for providing dimensional stability to the wall covering material and the moisture content is thereby controlled.

2. A package according to claim 1 in which the hydrophilic substrate layer comprises hydrophilic fibres.

3. A package according to claim 2 in which the hydrophilic fibres are cellulosic.

4. A package according to claim 2 or claim 3 in which the moisture content in the package, based on the total amount of hydrophilic fibres, is at least 15% by weight.

5. A package according to claim 1 in which y is in the range −0.5 to 0.5.

6. A package according to claim 1 in which z is in the range 0.5 to 0.90.

7. A package according to claim 1 in which the moisture content of the material in the package is greater than the equilibrium moisture content of the material under the conditions 23° C. and 50% relative humidity.

8. A package according to claim 1 in which the sealed container comprises a thermoplastic film which encloses the roll.

9. A package according to claim 1 in which the decorative layer includes a layer of a plastics material.

10. A package according to claim 1 in which the release surface is carried directly on the decorative layer, so that the product is a self-wound product.

11. A process for producing a package containing a roll of wallcovering material in which there are applied to a web of hydrophilic substrate material, on one side a decorative surface layer and on the other side a layer of pressure sensitive adhesive and the product web is wound into rolls of successive windings with the pressure sensitive adhesive received onto a release surface of the adjacent winding in the product roll, and the roll is then enclosed in a sealed container, in which the wall covering material is such that it will undergo an increase in area from dry area d to a wet area w of at least 0.01% of d when subjected to a wet expansion test, and wherein the area of the wallcovering material when the roll is enclosed in the sealed container is in the range $$m-y\Delta \leqq x \leqq \mu+z\Delta$$

where $\mu$ is $$\frac{d+w}{2}$$

$\Delta$ is $$\frac{w-d}{2}$$

y is in the range −0.5 to 0.8 z is in the range −0.8 to 0.95

12. A process according to claim 11 carried out in the presence of moisture, in which the moisture content of the web before winding is determined.

13. A process according to claim 12 in which the result of the determination of the moisture content is used to adjust the process conditions so as to alter the moisture content of the web in the product.

14. A process according to claim 13 which includes a drying step downstream from the moisture determination and in which the drying conditions are adjusted as a result of the moisture content determination.

15. A process according to claim 11 in which the adhesive is applied as an aqueous-based composition to the substrate and the adhesive coated substrate is subsequently dried.

16. A process according to claim 11 in which the hydrophilic substrate layer comprises hydrophilic fibres, preferably of cellulosic material.

17. A process according to claim 16 in which the moisture content on the basis of hydrophilic fibres is at least 5% by weight.

18. A process according to claim 11 in which the decorative surface layer includes a layer of a plastics material, applied to the web of hydrophilic substrate material by application of a liquid composition.

19. A process according to claim 11 in which a release layer is applied directly on the decorative surface to provide a release surface on the product web and the web is self-wound, with no independent release sheet, on the roll.

20. A process for producing a package containing a roll of wallcovering material in which there are applied to a web of hydrophilic substrate material, on one side a decorated surface layer and on the other side a layer of pressure sensitive adhesive and the product web is wound into rolls of successive winding with the pressure sensitive adhesive received onto a release surface of the adjacent winding in the product roll, and the roll is then enclosed in a sealed container, in which the wall covering material is such that it will undergo an increase in area from a dry area d to wet area w of at least 0.01% of d when subjected to a wet expansion test wherein the process is carried out in the presence of moisture and the moisture content of the web before it is wound is determined.

21. A package according to claim 2 or claim 3 in which the moisture content in the package, based on the total amount of hydrophilic fibers, is at least 18% by weight.

22. A package according to claim 1 in which y is in the range −0.25 to 0.25.

23. A package according to claim 2 in which x is in the range 0.25 to 0.75.

24. A process according to claim 11 in which the decorative surface layer includes a layer of a plastics material applied to the web of hydrophilic substrate material by laminating a pre-formed film.

25. A process according to claim 18 in which the plastics web material comprises polyvinylchloride.

26. A process according to claim 18 in which the liquid composition applied to the web of hydrophilic substrate material is a plastisol.

27. A package comprising a sealed container in combination with a roll of wallcovering material for application to a wall in strips, said sealed container containing said roll of wallcovering material and said wallcovering material comprising in sequence a pressure sensitive adhesive layer, a hydrophilic substrate layer comprising hydrophilic fibers, a decorative layer and release surface, the adhesive layer of one winding being received on the release surface of the adjacent winding, in which said wallcovering material is such that it will undergo an increase in area from a dry area d to a wet area w of at least 0.1% of d when subjected to a wet expansion test and herein said wallcovering material in the package has an area which is such that $$\mu-y\Delta \leqq x \leqq \mu+z\Delta$$

where $\mu$ is $(d+w)/2$ $\Delta$ is $(w-d)/2$ y is in the range −0.5 to 0.8 z is in the range −0.8 to 0.95, and the moisture content in the package, based on the total amount of hydrophilic fibers, is at least 15% by weight.

28. A package according to claim 27 in which the moisture content in the package, based on the total weight of hydrophilic fibers is at least 17%.

* * * * *